US008343429B2

(12) United States Patent
Yabu et al.

(10) Patent No.: US 8,343,429 B2
(45) Date of Patent: Jan. 1, 2013

(54) TARGET SUPPLY UNIT OF EXTREME ULTRAVIOLET LIGHT SOURCE APPARATUS AND METHOD OF MANUFACTURING THE SAME

(75) Inventors: Takayuki Yabu, Hiratsuka (JP); Takanobu Ishihara, Hiratsuka (JP); Masaki Nakano, Hiratsuka (JP)

(73) Assignee: Gigaphoton Inc., Tokyo (JP)

( * ) Notice: Subject to any disclaimer, the term of this patent is extended or adjusted under 35 U.S.C. 154(b) by 301 days.

(21) Appl. No.: 12/581,461

(22) Filed: Oct. 19, 2009

(65) Prior Publication Data

US 2010/0143202 A1 Jun. 10, 2010

(30) Foreign Application Priority Data

Oct. 17, 2008 (JP) ..... 2008-269050

(51) Int. Cl.
*G21K 5/08* (2006.01)

(52) U.S. Cl. ..... 422/110; 422/111; 422/119; 250/504 R

(58) Field of Classification Search ..... 422/108, 422/110, 111, 119; 250/504 R
See application file for complete search history.

(56) References Cited

U.S. PATENT DOCUMENTS 7,122,816 B2 * 10/2006 Algots et al. ..... 250/504 R

FOREIGN PATENT DOCUMENTS

JP 2005032510 A * 2/2005
JP 2008-98081 4/2008

OTHER PUBLICATIONS

English Abstract and Machine Translation for JP 2005-032510 A (Feb. 2005).*

* cited by examiner

*Primary Examiner* — Jennifer A Leung
(74) *Attorney, Agent, or Firm* — McDermott Will & Emery LLP

(57) ABSTRACT

In a target supply unit of an extreme ultraviolet light source apparatus for generating extreme ultraviolet light by applying a laser beam to a target material to turn the target material into plasma, clogging of a target nozzle for supplying the target material to a laser beam application point is suppressed. The target supply unit includes: a target container for accommodating the target material; a target nozzle for injecting the target material supplied from the target container; and a reducing gas supply unit for supplying a reducing gas into the target container. Instead of using the reducing gas, a carbon-based material having a reduction action may be provided within the target container for causing reduction reaction.

15 Claims, 8 Drawing Sheets

TARGET SUPPLY UNIT OF EXTREME ULTRAVIOLET LIGHT SOURCE APPARATUS AND METHOD OF MANUFACTURING THE SAME

CROSS-REFERENCE TO RELATED APPLICATION

The present application claims priority from Japanese Patent Application No. 2008-269050 filed on Oct. 17, 2008, the contents of which are incorporated herein by reference in their entirety.

BACKGROUND OF THE INVENTION

1. Field of the Invention

The present invention relates to a target supply unit to be used for supplying a target in an extreme ultraviolet (EUV) light source apparatus and a method of manufacturing the target supply unit.

2. Description of a Related Art

In recent years, as semiconductor processes become finer, photolithography has been making rapid progress toward finer fabrication. In the next generation, microfabrication at 60 nm to 45 nm, further, microfabrication at 32 nm and beyond will be required. Accordingly, in order to fulfill the requirement for microfabrication at 32 nm and beyond, for example, exposure equipment is expected to be developed by combining an EUV light source for generating EUV light having a wavelength of about 13 nm and reduced projection reflective optics.

As the EUV light source, there is an LPP (laser produced plasma) type EUV light source using plasma generated by applying a laser beam to a target. The LPP type EUV light source has advantages that extremely high intensity close to black body radiation can be obtained because plasma density can be considerably made higher, that light of only the particular waveband can be radiated by selecting the target material, and that an extremely large collection solid angle can be ensured because it is a point source having a substantially isotropic angle distribution and there is no structure such as electrodes surrounding the light source. Therefore, the LPP type EUV light source is predominant as a light source for photolithography.

In the LPP type EUV light source apparatus, the EUV light, which is emitted from plasma generated by applying a laser beam to a target material of tin or the like within a vacuum chamber, is reflected by an EUV collector mirror provided within the vacuum chamber and emitted to the outside. When debris generated from the target material adheres to the EUV collector mirror, the reflectivity of the EUV collector mirror for EUV light having a wavelength of 13.5 nm becomes lower, and as a result, EUV light output emitted to the outside becomes lower. On this account, it is necessary to reduce the debris generated from the target material.

As a related technology, Japanese Patent Application Publication JP-P2008-98081A discloses a method of adjusting energy of a laser beam to suppress generation of debris. Further, there is known a method of suppressing debris by supplying the minimum amount of target necessary for obtaining desired EUV energy. According to this method, typically, the target is formed in minute spherical shapes having diameters of several micrometers to several tens of micrometers. In order to obtain the shapes, a molten metal is injected from a microscopic injection hole having a diameter of several tens of micrometers formed in a target nozzle into vacuum. However, since the injection hole is extremely narrow, there has been a problem that oxides contained in the molten metal, impurities transferred from a target container or contained in the molten metal, a metal solidified due to temperature nonuniformity, or the like clogs the injection hole, and injection of the molten metal becomes impossible. Particularly, the most common cause of the injection hole clogging is oxides adhered to a metal surface before melting or contained in the metal, or oxides adhered to an inner wall of the target container.

The applicant have searched, but not found any prior art documents that point out problems about clogging in the target injection hole of the target supply unit or disclose their technical solutions.

SUMMARY OF THE INVENTION

The present invention has been achieved in view of the above-mentioned problems. A purpose of the present invention is, in a target supply unit of an extreme ultraviolet light source apparatus for generating extreme ultraviolet light by applying a laser beam to a target material to turn the target material into plasma, to suppress clogging of a target nozzle for supplying the target material to a laser beam application point.

In order to accomplish the above-mentioned purpose, a target supply unit according to a first aspect of the present invention is a target supply unit to be used in an extreme ultraviolet light source apparatus for generating extreme ultraviolet light by applying a laser beam to a target material to turn the target material into plasma, and the target supply unit includes: a target container for accommodating the target material; a target nozzle for injecting the target material supplied from the target container; and a reducing gas supply unit for supplying a reducing gas into the target container.

Further, a target supply unit according to a second aspect of the present invention is a target supply unit to be used in an extreme ultraviolet light source apparatus for generating extreme ultraviolet light by applying a laser beam to a target material to turn the target material into plasma, and the target supply unit includes: a target container including a carbon-based material having a reduction action, for accommodating the target material; and a target nozzle for injecting the target material supplied from the target container.

Furthermore, a method of manufacturing a target supply unit according to a third aspect of the present invention is a method of manufacturing a target supply unit to be used in an extreme ultraviolet light source apparatus for generating extreme ultraviolet light by applying a laser beam to a target material to turn the target material into plasma, and the method includes the steps of: (a) accommodating the target material within a target container connected to a target nozzle; (b) reducing an oxide contained in the target material accommodated within the target container; and (c) sealing the target container.

According to the present invention, the oxide contained in the target material is reduced and dissolved by the reducing gas or the carbon-based material having a reduction action, and thereby, clogging of the target nozzle can be suppressed.

DESCRIPTION OF THE PREFERRED EMBODIMENTS

Figure 1:
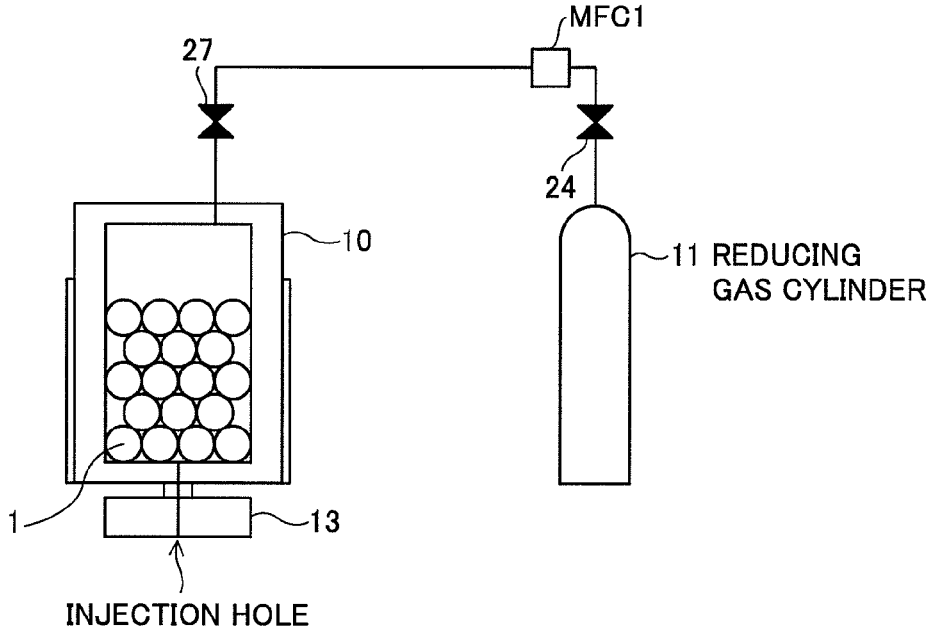
FIG. 1 is a basic diagram of a target supply unit according to the first embodiment of the present invention.

Hereinafter, preferred embodiments of the present invention will be explained in detail by referring to the drawings. The same reference numerals are assigned to the same component elements and the explanation thereof will be omitted.

First Embodiment

FIG. 1 is a basic diagram of a target supply unit according to the first embodiment of the present invention. The target supply unit as shown in FIG. 1 is provided in an upper part of a vacuum chamber, in which a target is turned into plasma, and supplies the target to a focusing point of a laser beam focused at high density. The target supply unit includes a target container 10 filled with a target material 1 such as tin (Sn), lithium (Li), or the like, and a target nozzle 13 formed with a target path as a microscopic injection hole having a diameter of several tens of micrometers. The target container 10 is connected to a reducing gas cylinder 11 via a pipe.

The reducing gas cylinder 11 is filled with a reducing gas such as hydrogen gas ($H_2$) or carbon monoxide gas (CO) having strong reducing power, for example. In the case where the hydrogen gas is used as the reducing gas, it is preferable to use a material that is hard to cause hydrogen brittleness, for example, SUS 316 or the like as a material of the target container 10.

In the route of the pipes connecting the target container 10 to the reducing gas cylinder 11, a mass flow controller MFC1 and changeover valves 24 and 27 are provided. By operating or controlling these, supply of the reducing gas to the target container 10, sealing and evacuation of the target container 10, and so on are performed. Here, the reducing gas cylinder 11, the mass flow controller MFC1, and the changeover valve 24 form a reducing gas supply unit for supplying the reducing gas into the target container 10.

According to the above-mentioned configuration, the reducing gas can be introduced into the target container 10 to perform reduction reaction of oxides contained in the target material 1. By reducing the oxides contained in the target material 1, an oxide of the reducing gas, for example, water or water vapor ($H_2O$), or carbon dioxide gas ($CO_2$) is produced. When the reduction reaction is almost completed, the supply of the reducing gas is stopped.

Through the procedure, in the case where tin is used as the target material 1, the tin oxide adhered to the tin target within the target container 10 is reduced and changed to a tin metal. In this manner, by decreasing the oxide contained in the target material 1, the amount of the solid material in the molten metal becomes smaller when the metal as the target material 1 is melted, and clogging of the target nozzle 13 becomes hard to occur.

As below, the respective examples of the present invention will be explained.

First Example

Figure 2:
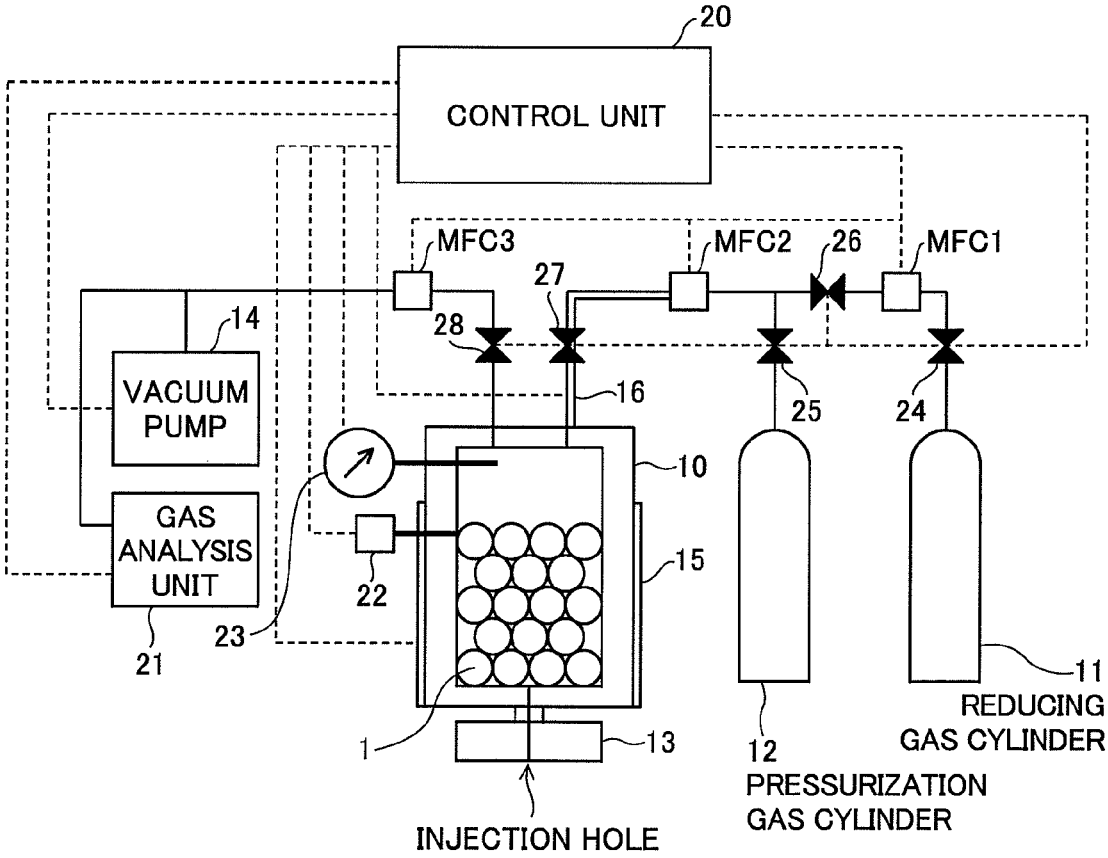
FIG. 2 is a diagram showing a configuration of the target supply unit according to the first example of the present invention.

FIG. 2 is a diagram showing a configuration of the target supply unit according to the first example of the present invention. In the target supply unit according to the example, the target container 10 is connected to the reducing gas cylinder 11, a pressurization gas cylinder 12, a vacuum pump 14, and a gas analysis unit 21 via pipes.

Further, to the target container 10, a heater 15, a temperature sensor 22, and a pressure sensor 23 are attached. The heater 15 is for heating and melting the target material 1, and heating the reducing gas to adjust a reaction temperature. To the pipe of the reducing gas, also a heater 16 for heating the reducing gas to adjust a reaction temperature is attached.

In the route of the pipe connecting the target container 10 to the reducing gas cylinder 11, the pressurization gas cylinder 12, the vacuum pump 14, and the gas analysis unit 21, mass flow controllers MFC1, MFC2, MFC3, and changeover valves 24-28 are provided. Here, the pressurization gas cylinder 12, the mass flow controller MFC2, and the changeover valve 25 form a pressurization gas supply unit for supplying a pressurization gas into the target container 10. The pressurization gas is used for adjusting the pressure within the target container 10 and diluting the reducing gas. The mass flow controllers MFC1, MFC2, MFC3 and the changeover valves 24-28 execute supply of gases to the target container 10, sealing and evacuation of the target container 10, and so on under the sequence control of a control unit 20.

Figure 3:
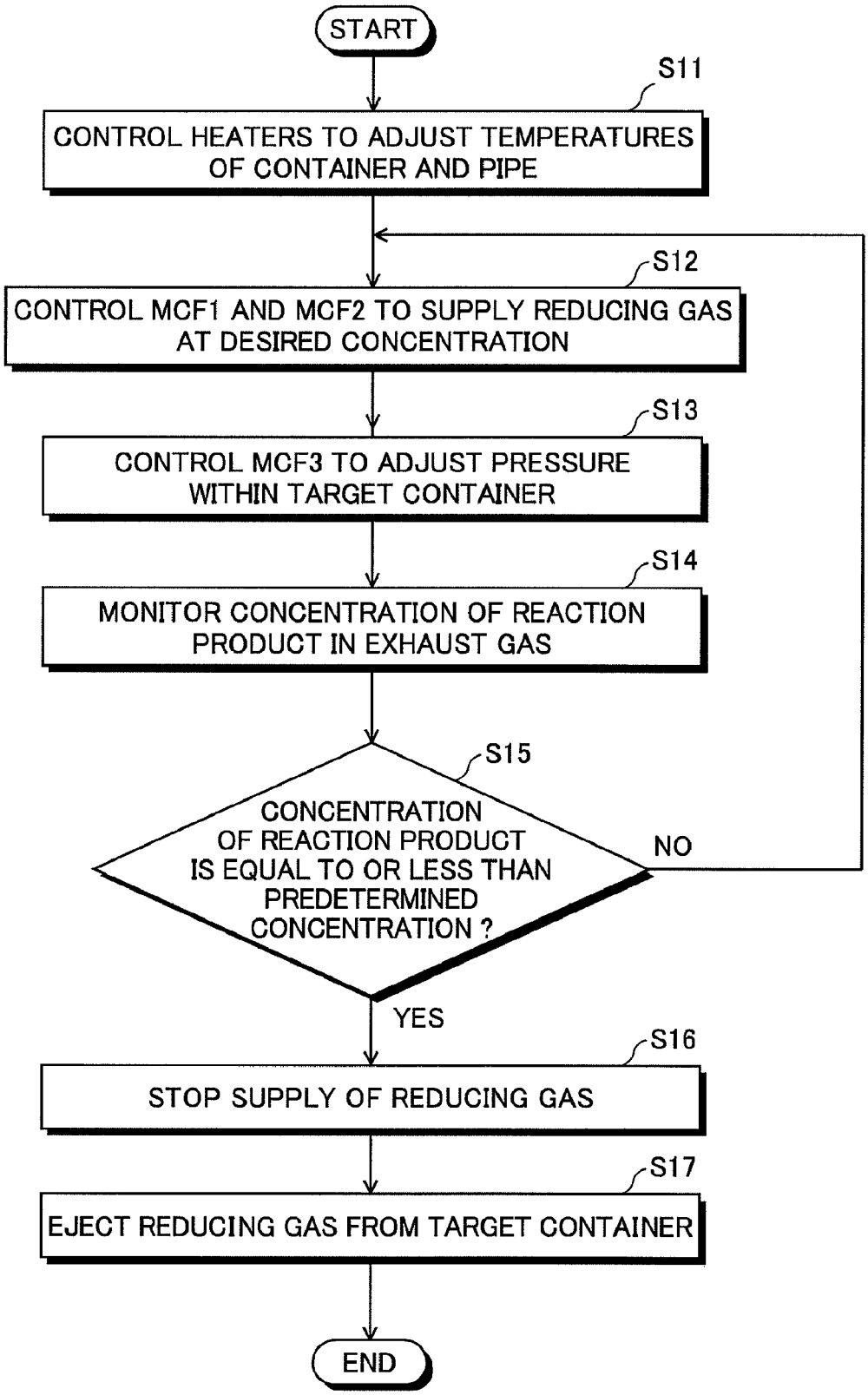
FIG. 3 is a flowchart showing a reduction operation of the target supply unit according to the first example of the present invention.

FIG. 3 is a flowchart showing a reduction operation of the target supply unit according to the first example of the present invention. The higher a temperature of the reducing gas becomes, the more the reduction reaction of the oxides contained in the target material 1 is promoted. Therefore, the control unit 20 controls the heaters 15 and 16 to raise temperatures of the target container 10 and the reducing gas pipe to a desired temperature and adjust the temperatures of them (step S11).

Then, the control unit 20 controls the changeover valves 24-28 to start the supply of the reducing gas, and controls the mass flow controllers MFC1 and MFC2 to supply the reducing gas at desired concentration into the target container 10, and thereby, causes the reduction reaction of the target material 1 (step S12). The reducing gas concentration can be adjusted according to the set value of the mass flow controller MFC1 provided near the reducing gas cylinder 11 and the set value of the mass flow controller MFC2 provided in a location where the pressurization gas is added to the reducing gas. Here, the optimal reducing gas concentration may be determined by experiments or the like in advance, or automatically determined according to a measurement result of the gas analysis unit. The dilution of the reducing gas may be performed by using the pressurization gas as shown in FIG. 2, or by using an appropriate diluting gas separately. Alternatively, a reducing gas having concentration appropriately adjusted in advance may be used.

Further, the control unit 20 controls the mass flow controller MFC3 provided in an exhaust pipe to adjust the pressure within the target container 10 (step S13). The gas passing through the mass flow controller MFC3 is exhausted to the atmosphere via the vacuum pump 14. In the case where the reducing gas is hydrogen gas ($H_2$), the hydrogen gas is diluted or burnt and released into the atmosphere because the hydrogen gas has explosiveness. On the other hand, in the case where the reducing gas is carbon monoxide gas (CO), the carbon monoxide gas is detoxified and released into the atmosphere because the carbon monoxide gas has toxicity. The target nozzle 13, which is provided to the target container 10 and formed with a target path as a microscopic injection hole, is opened to the vacuum chamber. Accordingly, the gas within the target container 10 flows out into the vacuum chamber, and therefore, it is preferable that the gas within the vacuum chamber is also evacuated by the vacuum pump, treated in the same manner as that described above, and released into the atmosphere.

By reducing the oxides contained in the target material 1 by using the reducing gas, a reaction product (oxide) of the reducing gas, for example, water or water vapor ($H_2O$), or carbon dioxide gas ($CO_2$) is produced. In the case where the target material 1 is tin (Sn), it is recommended that the reaction temperature is set slightly lower than the melting temperature of tin, that is, 232° C. The oxide of the target material 1 is formed on the surface of the target material 1, and thus, in order that the reducing gas acts on the oxides of the target material 1, it is preferable that tin does not melt, but holds its solid shape.

The reducing gas deprives the oxide of the target material 1 of oxygen by the reduction reaction, and becomes a reaction product (an oxide of the reducing gas) such as water ($H_2O$) or carbon dioxide gas ($CO_2$). The gas analysis unit 21 provided in the route of the exhaust pipe monitors concentration of the reaction product to output a monitor signal representing the concentration of the reaction product. As the gas analysis unit 21, a dew-point meter, a Fourier transform infrared spectrophotometer (FT-IR), or the like can be used. The control unit 20 monitors the concentration of the reaction product in the exhaust gas based on the monitor signal outputted from the gas analysis unit 21 (step S14), and determines whether or not the concentration of the reaction product is equal to or less than the predetermined concentration (step S15).

When the concentration of the reaction product is more than the predetermined concentration, the process returns to step S12. At the time when the concentration of the reaction product becomes equal to or less than predetermined concentration, the control unit 20 determines that the reduction treatment is almost completed. Alternatively, in the case where the time required for the reduction treatment is known beforehand, the reduction treatment may be controlled by the flow time of the reducing gas. When it is determined that the reduction treatment is almost completed, the control unit 20 controls the changeover valve 24 or 26 to stop the supply of the reducing gas (step S16).

Since the reducing gas left in the target container 10 or the pipe may have an adverse effect on the target production, it is preferable that the control unit 20 performs several times of purges by using the pressurization gas within the pressurization gas cylinder 12 and exhausts the reducing gas from the target container 10 (step S17).

Through the above-mentioned operation, the tin oxide within the target container 10 is reduced to become tin metal. In this manner, an amount of the oxide of the target material 1 is decreased, and thereby, an amount of the solid material within the molten metal becomes smaller when the metal as the target material 1 is melted, and the accidents are decreased in which the target nozzle is clogged.

In the above-mentioned operation, supply and exhaust of the reducing gas are performed at the same time. However, supply and exhaust of the reducing gas may be alternately performed. Further, in the above-mentioned operation, the reduction reaction of the oxides is performed while the target material 1 within the target container 10 remains in the solid state. However, the temperature of the target material 1 may be raised to a temperature higher than the melting point thereof by the heater 15, and the oxides may be reduced while the target material 1 is in the liquid phase state. When the oxides are reduced while the target material 1 is in the solid state, the reaction speed becomes high because the surface area is larger. On the other hand, when the oxides are reduced while the target material 1 is in the liquid state, the reaction speed becomes high because the reaction temperature is higher. It is preferable that a selection is made among the states depending on conditions such as a gas contact area according to shapes of the target material and the target container and so on, and thereby, the reduction reaction is performed at the higher reaction speed. When the oxides are reduced while the target material 1 is in the liquid state, the liquid-state target material 1 flows out from the injection hole of the target nozzle 13 according to the differential pressure between the target container 10 and the vacuum chamber. Therefore, it is desirable that the pressure within the vacuum chamber is slightly raised by using an inert gas or the like so that the target material 1 does not flow out at the reduction stage.

When the target material 1 is supplied into the vacuum chamber, the control unit 20 controls the heater 15 to raise the temperature of the target container 10 to a predetermined temperature and melt the target material 1. Further, the control unit 20 controls the pressurization gas supply unit to introduce the pressurization gas into the target container 10, and thereby, the molten target material is injected from the injection hole formed in the target nozzle 13 into the vacuum chamber.

Second Example

Figure 4:
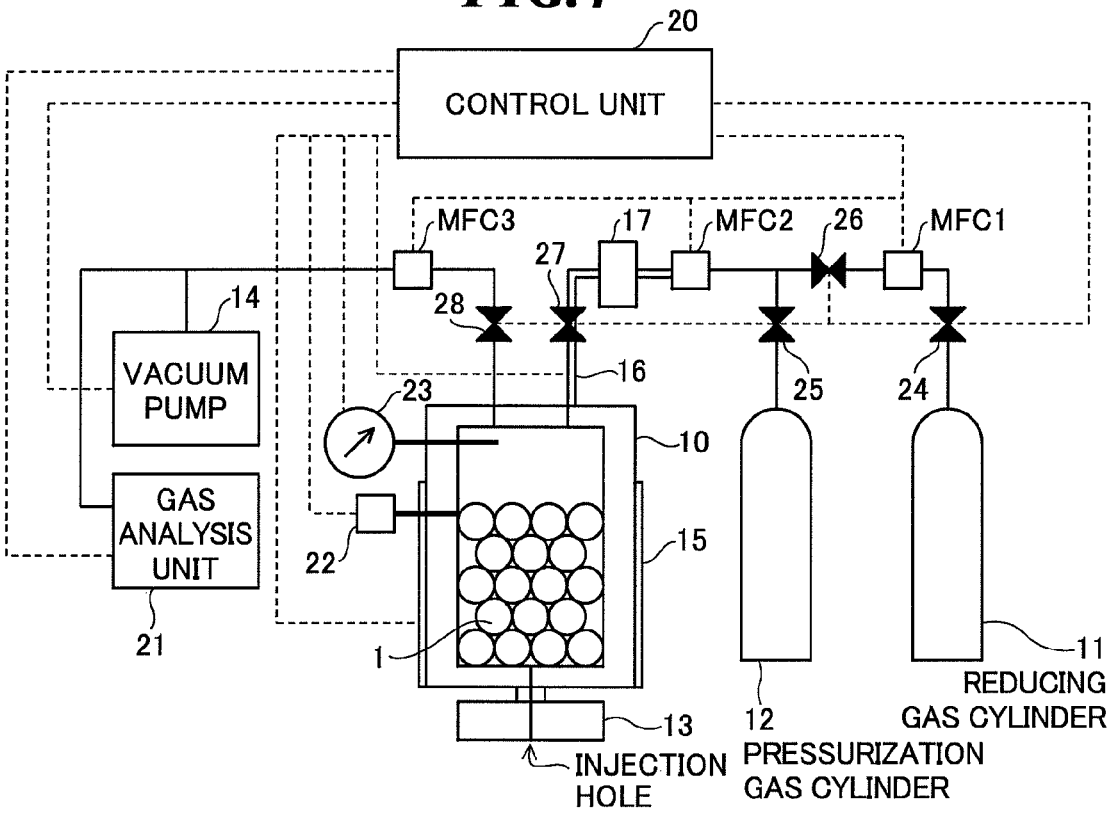
FIG. 4 is a diagram showing a configuration of a target supply unit according to the second example of the present invention.

FIG. 4 is a diagram showing a configuration of a target supply unit according to the second example of the present invention. Since the normal-state hydrogen gas ($H_2$) has weaker reducing power than the radical-state hydrogen (hydrogen radical), the reduction reaction speed can be made higher by using the hydrogen radical having the stronger reducing power. Accordingly, in the target supply unit according to the example, the reducing gas is radicalized before being supplied to the target container 10, and thereby, the efficiency of the reduction reaction is made higher. For the purpose, a radicalizing unit 17 for radicalizing the reducing gas is provided in the route of the reducing gas supply pipe. The rest of the configuration is the same as that of the first example.

The radicalizing unit 17 includes a microwave plasma unit, or a high-temperature heating unit using a filament formed of a material having a high melting point such as tungsten, or the like, and can radicalize the reducing gas while the reducing gas passes therethrough. The radicalizing unit 17 is disposed in a location as close as possible to the target container 10 so that a sufficient amount of the reducing gas reaches the target material 1 before the radicalized reducing gas becomes inactivated.

The target supply unit according to the example efficiently reduces the oxides contained in the target material 1 or the oxides separated from the target container 10 and mixed in the target material 1 back to metal components, and thus, the oxide components clogging the injection hole of the target nozzle 13 are decreased and the frequency of the clogging accidents becomes lower.

Third Example

Figure 5:
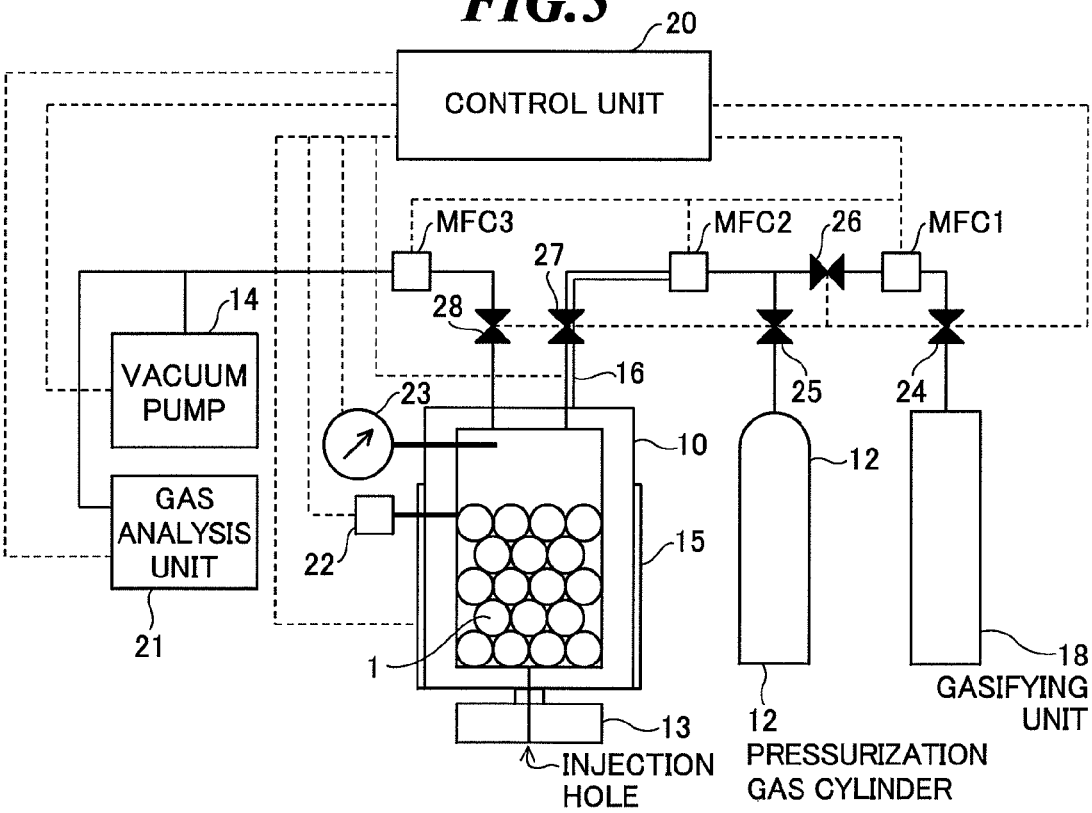
FIG. 5 is a diagram showing a configuration of a target supply unit according to the third example of the present invention.

FIG. 5 is a diagram showing a configuration of a target supply unit according to the third example of the present invention. The third example is characterized in that a reducing agent, which is in a liquid state at room temperature, is gasified to be the reducing gas, and includes a gasifying unit 18 in place of the reducing gas cylinder 11 in the first example. The gasifying unit 18 gasifies the reducing agent by heating or bubbling, and an acid solution containing formic acid, acetic acid, hydrochloric acid, or the like may be used as the reducing agent.

Fourth Example

Figure 6:
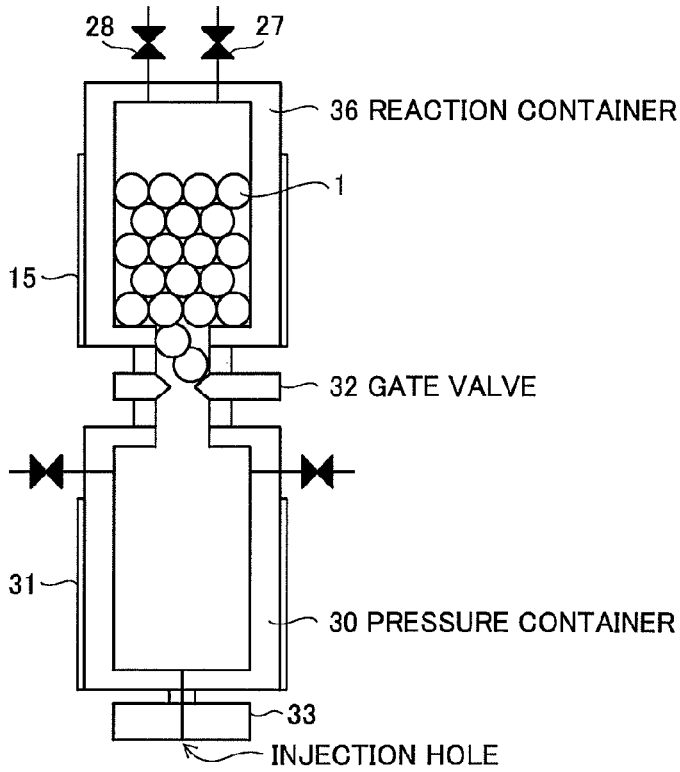
FIG. 6 is a diagram showing a partial configuration of a target supply unit according to the fourth example of the present invention.

FIG. 6 is a diagram showing a partial configuration of a target supply unit according to the fourth example of the present invention. In the fourth example, a pressure container 30 is provided in addition to a reaction container (target container) 36, and a gate valve 32 is provided between the reaction container 36 and the pressure container 30 to connect them. The rest of the configuration is the same as those in the first to third examples.

In the fourth example, the reduction treatment of the target material 1 is performed within the reaction container 36 separated from the pressure container 30 requiring pressurization. When the gate valve 32 is opened after the reduction treatment of the target material 1 is finished, the target material 1 moves from the reaction container 36 to the pressure container 30 through a target transfer path connecting the reaction container 36 and the pressure container 30. Then, the target material 1 is melted by a heater 31 attached to the pressure container 30, and the interior of the pressure container 30 is pressurized, and thereby, the droplet target is supplied into the vacuum chamber through an injection hole of a target nozzle 33.

When the target material 1 is moved from the reaction container 36 to the pressure container 30, it is desirable that the interior of the pressure container 30 is sufficiently evacuated by using the vacuum pump 14 and the evacuation pipe. In the case where the interior of the reaction container 36 is pressurized by opening the gate valve 32 when the target is supplied from the pressure container 30 into the vacuum chamber, the pressure resistance of the gate valve 32 is not necessary to be excessive, but the same pressure resistance as that of the pressure container 30 is required for the reaction container 36. On the other hand, in the case where the pressurizing pipe and the evacuation pipe are provided to the pressure container 30, and the target is supplied by closing the gate valve 32 and pressurizing the interior of the pressure container 30 by the pressurization gas supply unit, the pressure resistance is required for the gate valve 32, but the high pressure resistance is not required for the reaction container 36.

According to the example, since the reaction container 36 and the pressure container 30 are separated, the target material is supplied from the pressure container 30 into the vacuum chamber while the reduction treatment of the subsequent target material is performed within the reaction container 36 at the same time, and thereby, the downtime in the supply of the target material can be shortened.

Second Embodiment

Figure 7:
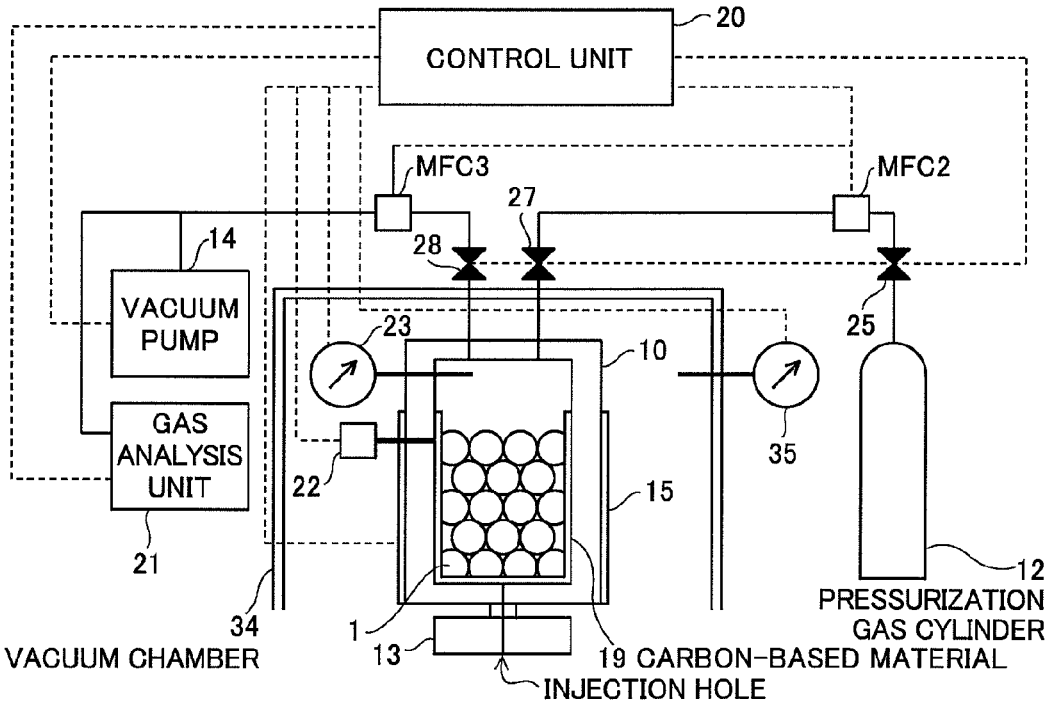
FIG. 7 is a diagram showing a configuration of a target supply unit according to the second embodiment of the present invention.

FIG. 7 is a diagram showing a configuration of a target supply unit according to the second embodiment of the present invention. The target supply unit according to the embodiment is characterized in that reduction treatment of oxides contained in the target material is performed by using a carbon-based material having a reduction action (reduction function) prepared within the target container instead of supplying the reducing gas from the outside into the target container.

The target supply unit according to the embodiment supplies a target to a laser beam focusing point within a vacuum chamber 34 in which the target is turned into plasma. The target supply unit includes a target container 10 filled with a target material 1 such as tin (Sn), lithium (Li), or the like, and a target nozzle 13 formed with a target path as an injection hole having a diameter of several tens of micrometers. The target container 10 is connected to a pressurization gas cylinder 12, a vacuum pump 14, and a gas analysis unit 21 via pipes. Further, to the target container 10, a heater 15, a temperature sensor 22, and a pressure sensor 23 are attached. The heater 15 is for heating and melting the target material 1, and adjusting a reaction temperature. Furthermore, a vacuum gauge 35 is provided to the vacuum chamber 34.

A carbon-based material 19 having a reduction action is disposed within the target container 10. The target material 1 filling the interior of the target container 10 is heated by the heater 15, melted at a high temperature, and comes into contact with the carbon-based material 19. Thereby, the oxides contained in the target material 1 are reduced, and carbon dioxide gas ($CO_2$) is produced. As the carbon-based material 19 having a reduction action, graphite or a composite containing carbon is used. The composite containing carbon includes carbon composite fibers called C/C composite, for example. The C/C composite is a material in which graphite is reinforced with carbon fibers, and has light weight, high strength, high elasticity, and high heat-resistance.

The target supply unit according to the embodiment may not necessarily employ a reducing gas cylinder. In the route of the pipes connecting the target container 10 to the pressurization gas cylinder 12, the vacuum pump 14, and the gas analysis unit 21, mass flow controllers MFC2 and MFC3, and changeover valves 25, 27, 28 are provided. Here, the pressurization gas cylinder 12, the mass flow controller MFC2 and the changeover valve 25 form a pressurization gas supply unit for supplying a pressurization gas into the target container 10. The pressurization gas is used for adjusting the pressure within the target container 10. The mass flow controllers MFC2 and MFC3 and the changeover valves 25, 27, 28 execute supply of gases to the target container 10, sealing and evacuation of the target container 10, adjustment of the internal pressure of the vacuum chamber 34, or the like under the sequence control of a control unit 20.

Figure 8:
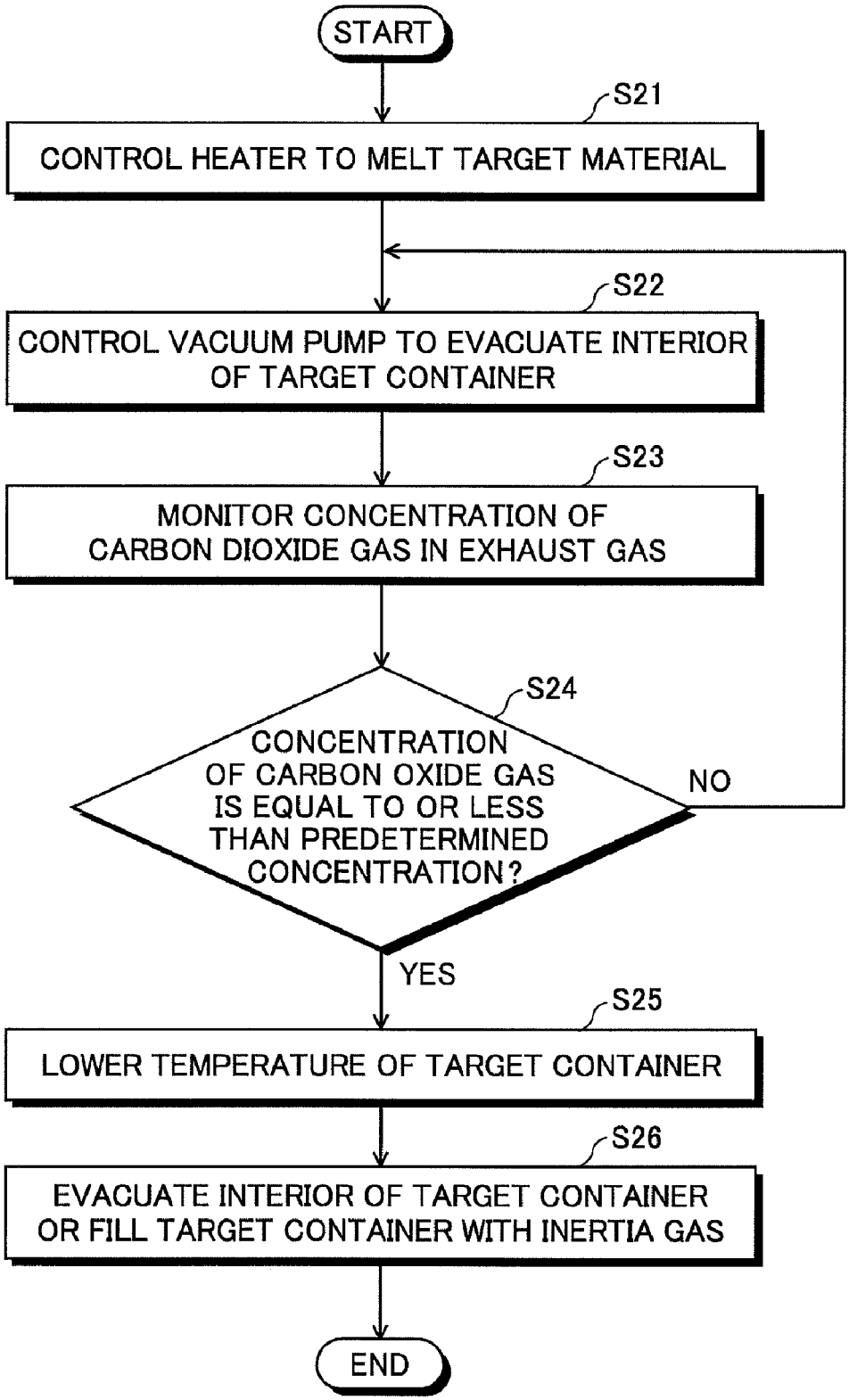
FIG. 8 is a flowchart showing a reduction operation of the target supply unit according to the second embodiment of the present invention.

FIG. 8 is a flowchart showing a reduction operation of the target supply unit according to the second embodiment of the present invention. The control unit 20 controls the heater 15 to raise the temperature of the target container 10 to a predetermined temperature and melt the target material 1 (step S21). Here, the higher the reaction temperature becomes, the more the reaction is promoted, and thus, it is preferable that the temperature is raised to an appropriate temperature.

When the temperature of the target material 1 reaches the temperature at which reduction reaction occurs, the oxides contained in the target material 1 react with the carbon-based material 19 within the target container 10, and carbon dioxide gas ($CO_2$) is produced. Then, the control unit 20 controls the vacuum pump 14 to evacuate the interior of the target container 10, and thereby, the carbon dioxide is exhausted into the atmosphere (step S22).

Alternatively, the carbon dioxide may be exhausted by purging the target container 10 by using an inertia gas or the like stored within the pressurization gas cylinder 12. When the interior of the target container 10 is pressurized by an inertia gas or the like, the pressure within the target container 10 rises, and the control unit 20 controls the mass flow controllers MFC2 and MFC3 to adjust the pressure within the target container 10. Further, the control unit 20 adjusts the pressure within the vacuum chamber 34 so that the molten target material may not be injected from the target nozzle 13. In order to adjust the internal pressure of the vacuum chamber 34, an appropriate amount of inertia gas may be introduced from the pressurization gas cylinder 12 into the vacuum chamber 34 via a pipe and a mass flow controller. Alternatively, a pressure adjustment gas may be used.

By reducing the oxides contained in the target material 1, carbon dioxide gas ($CO_2$) is produced. The gas analysis unit 21 such as an FT-IR provided in the route of the exhaust pipe monitors the concentration of the carbon dioxide gas and outputs a monitor signal representing the concentration of the carbon dioxide gas. The control unit 20 monitors the concentration of the carbon dioxide gas in the exhaust gas based on the monitor signal outputted from the gas analysis unit 21 (step S23), and determines whether or not the concentration of the carbon dioxide gas is equal to or less than predetermined concentration (step S24).

When the concentration of the carbon dioxide gas is more than the predetermined concentration, the process returns to step S22. At the time when the concentration of the carbon dioxide gas becomes equal to or less than predetermined concentration, the control unit 20 determines that the reduction treatment is almost completed. Alternatively, the time required for the reduction treatment is known beforehand, the reduction treatment may be controlled by the flow time of the exhaust gas. When the reduction treatment is determined to be almost completed, the control unit 20 lowers the temperature of the target container 10 to stop the reduction reaction (step S25).

The control unit 20 prevents accidental reaction by evacuating the interior of the target container 10 or filling the target container 10 with an inertia gas (step S26).

Through the above-mentioned operation, when tin is used as the target material 1, a tin oxide within the target container 10 is reduced to become tin metal. In this manner, the oxides of the target material 1 are decreased, and thereby, the amount of the solid material within the molten metal is reduced when the metal as the target material 1 is melted, and the accidents are decreased in which the target nozzle is clogged.

When the target material 1 is supplied into the vacuum chamber, the control unit 20 controls the heater 15 to raise the temperature of the target container 10 to the predetermined temperature and melt the target material 1. Further, the control unit 20 controls the pressurization gas supply unit to introduce the pressurization gas into the target container 10, and thereby, the molten target material is injected from the injection hole formed in the target nozzle 13 into the vacuum chamber 34.

Fifth Example

Figure 9:
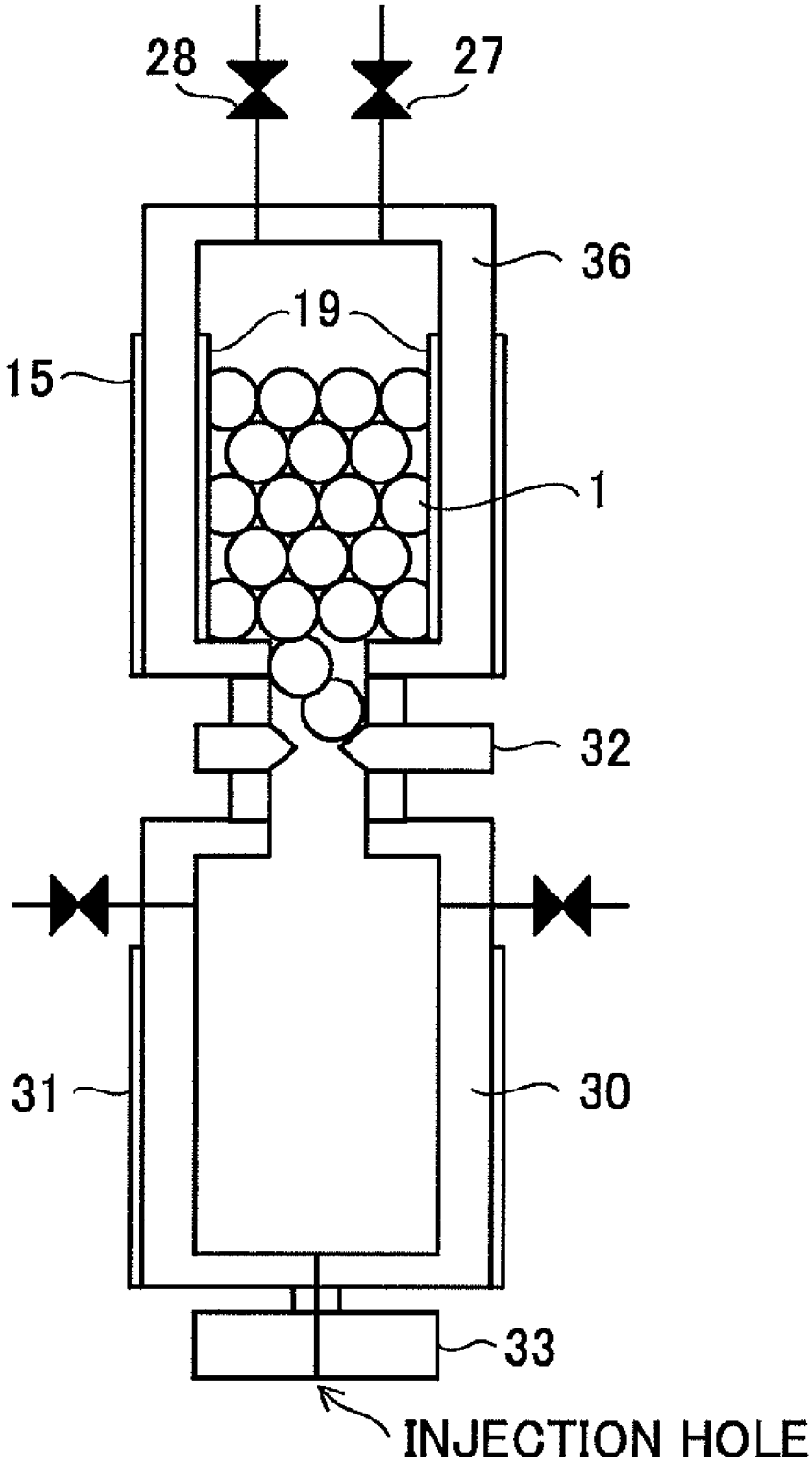
FIG. 9 is a diagram showing a partial configuration of a target supply unit according to the fifth example of the present invention.

FIG. 9 is a diagram showing a partial configuration of a target supply unit according to the fifth example of the present invention. In the fifth example, the target container 10 in the second embodiment is separated into a reaction container (target container) 36 and a pressure container 30 as in the fourth example, and a gate valve 32 is provided between the reaction container 36 and the pressure container 30 to connect them. The rest of the configuration is the same as that in the second embodiment. In the fifth example, in order to smoothly perform the reduction reaction of the target material 1 such as tin or the like with a carbon-based material having a reduction reaction, the reaction takes place under the condition at a high temperature. Therefore, the pressure-resistance of the reaction container 36 may be lowered due to the high temperature. On this account, it is reasonable to separate the reaction container 36 requiring high-temperature treatment and the pressure container 30 requiring pressurization for dropping the molten tin.

Accordingly, in the example, reduction reaction at a high temperature takes place within the reaction container 36 separated from the pressure container 30 requiring pressurization. After the reduction reaction is finished, the temperature of the target material is adjusted at a relatively low temperature and the gate valve 32 is opened, and then, the target material 1 moves to the pressure container 30. Then, a heater 31 attached to the pressure container 30 adjusts the temperature of the target material, and the pressurization gas supply unit pressurizes the interior of the pressure container 30, and thereby, the droplet target is supplied into the vacuum chamber through the injection hole of a target nozzle 33.

According to the example, since the reaction container 36 requiring a high-temperature environment and the pressure container 30 requiring a high-pressure environment are separated from each other, the respective required specifications are relaxed. Further, pressure resistance is not required for the reaction container 36, and the material of the container can be the carbon-based material.

(Manufacturing Method)

Figure 10:
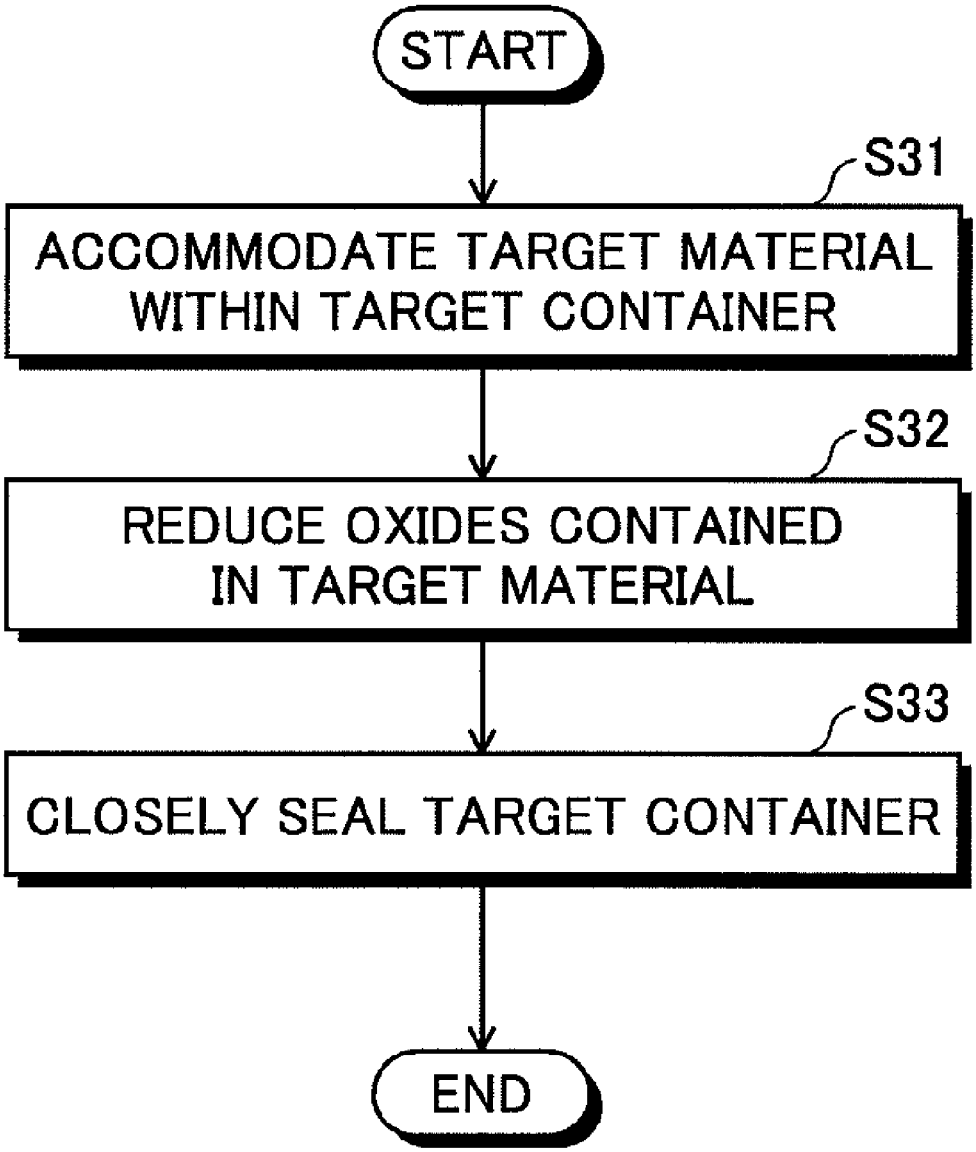
FIG. 10 is a flowchart showing a method of manufacturing a target supply unit according to one embodiment of the present invention.

FIG. 10 is a flowchart showing a method of manufacturing a target supply unit according to one embodiment of the present invention.

In the first to fourth examples as shown in FIGS. 2-6, the target supply units including the reducing gas cylinder 11 or gasifying unit 18 have been explained. In the case where the target supply unit is provided in an EUV light source apparatus, at the maintenance or the like of the EUV light source apparatus, a reducing gas can be introduced into the target supply unit to reduce oxides of a target material.

On the other hand, in FIG. 10, a method of manufacturing the target supply unit including neither reducing gas cylinder 11 nor gasifying unit 18 will be explained.

First, an operator accommodates a target material within a target container connected to a target nozzle with an injection hole sealed (step S31). For example, as shown in FIG. 1, a target material 1 is accommodated within the target container 10 connected to the reducing gas cylinder 11. Alternatively, as shown in FIG. 7, the target material 1 is accommodated within the target container in which the carbon-based material 19 is disposed.

Then, the operator reduces the oxides contained in the target material accommodated within the target container (step S32). For example, the step is executed by introducing the reducing gas from the reducing gas cylinder 11 into the target container 10 via the pipe in FIG. 1. Here, according to need, the reduction reaction may be promoted by heating the target container or the like. Alternatively, the step is executed by raising the temperature of the target container 10 to the predetermined temperature and melting the target material 1 in FIG. 7.

Through the step, the reduction reaction of the oxides of the target material occurs within the target container, and an oxide of the reducing gas or carbon is produced, and accordingly, the operator exhausts the gas produced within the target container by using the exhaust pipe connected to the target container. In this regard, according to need, the concentration of the oxide in the exhaust gas may be measured by a gas analysis unit provided to the exhaust pipe, and the reduction reaction may be finished when the concentration of the oxide in the exhaust gas is equal to or less than predetermined concentration. Further, after the concentration of the oxide becomes equal to or less than a fixed value, the interior of the target container may be evacuated by a vacuum pump, or a purge gas may be introduced into the target container by using a pressurization gas cylinder.

Then, the operator closely seals the target container (step S33). For example, in FIG. 2, the changeover valves 24-28 are closed, and the target container 10 together with the changeover valves 27 and 28 is separated from the mass flow controllers MFC2 and MFC3, the vacuum pump 14, the gas analysis unit 21, and so on, and then, the target supply unit is completed.

The above-mentioned steps are performed within a manufacturing plant of the target supply unit, and the target supply unit is mounted to the EUV light source apparatus in a location where the EUV light source apparatus is installed, and then, the target supply unit can be used in which the amount of oxides contained in the target material within the target container is smaller and the target nozzle is hard to be clogged.

(EUV Light Source Apparatus)

Figure 11:
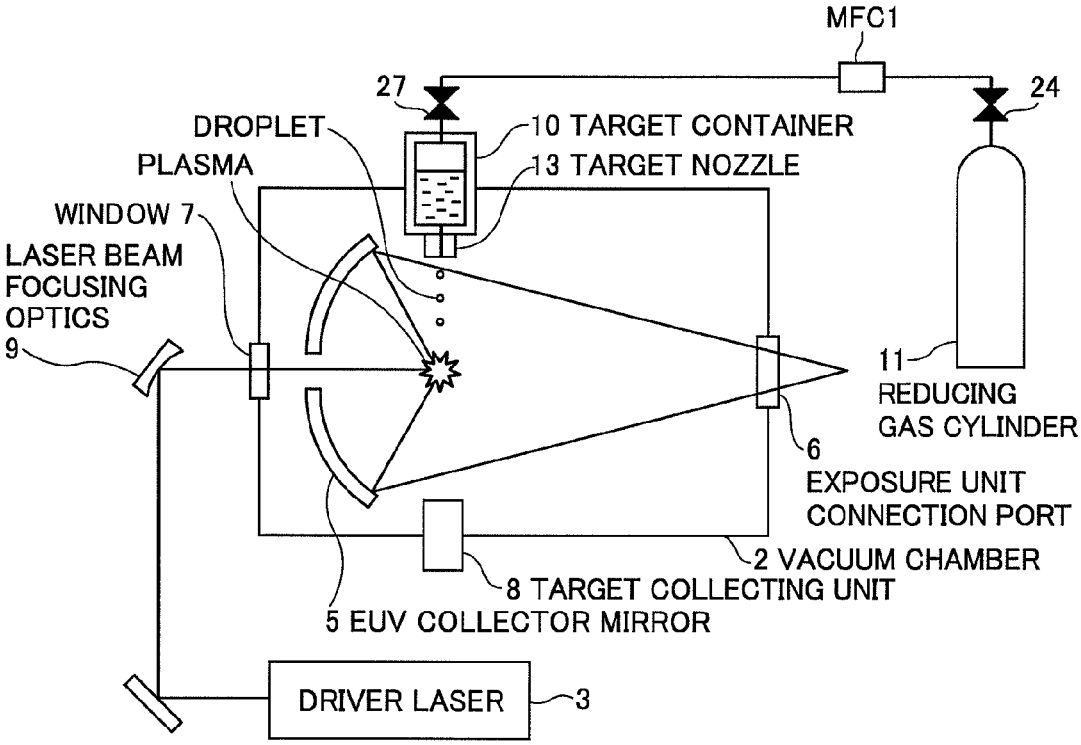
FIG. 11 is a diagram showing a configuration of an extreme ultraviolet light source apparatus including the target supply unit according to one embodiment of the present invention.

FIG. 11 is a diagram showing a configuration of an extreme ultraviolet light source apparatus including the target supply unit according to one embodiment of the present invention. The EUV light source apparatus employs a laser produced plasma (LPP) type for generating EUV light by applying a laser beam to a target material for excitation.

As shown in FIG. 11, the EUV light source apparatus includes a vacuum chamber 2, a target supply unit, a target collecting unit 8, a driver laser 3, and a laser beam focusing optics 9, and an EUV collector mirror 5.

The vacuum chamber 2 is a chamber in which EUV light is generated. In the vacuum chamber 2, a window 7 for passing a laser beam generated by the driver laser 3 into the vacuum chamber 2, and an exposure unit connection port 6 for outputting the EUV light generated within the vacuum chamber 2 to an exterior exposure unit are provided.

The target supply unit includes a target container 10, a target nozzle 13, a reducing gas cylinder 11, a mass flow controller MFC1, and changeover valves 24 and 27. A target material such as tin (Sn), lithium (Li), or the like is stored within the target container 10. Further, a microscopic injection hole for injecting the target material is formed in the target nozzle 13.

Within the target container 10, oxides contained in the target material are reduced by a reducing gas supplied from the reducing gas cylinder 11 via the changeover valve 24, the mass flow controller MFC1, and the changeover valve 27. The target material after reduction treatment is heated and melted within the target container 10 by a heater (not shown), and injected as droplets from the injection hole formed in the target nozzle 13. Among the droplets that have been supplied into the vacuum chamber 2, unnecessary droplets not irradiated with a laser beam are collected by the target collecting unit 8.

The drive laser 3 is a laser beam source for generating a pulsed laser beam having a high repetition rate. The laser beam focusing optics 9 includes at least one lens and/or at least one mirror. The laser beam generated by the driver laser 3 is focused on a droplet within the vacuum chamber 2 via the laser beam focusing optics 9 and the window 7 so as to form a focal point on the droplet. The droplet target material is excited by the energy of the laser beam to generate plasma, and various wavelength components including EUV light are radiated therefrom.

The EUV collector mirror 5 is a spheroidal mirror having a spheroidal concave reflection surface formed with a molybdenum (Mo)/silicon (Si) multilayer coating for selectively reflecting a particular wavelength component, for example, EUV light having a wavelength near 13.5 nm from among various wavelength components radiated from plasma. The EUV collector mirror 5 is disposed such that the first focal position of the spheroid is located at a plasma emission point, and the EUV light is focused on the second focal position of the spheroid, i.e., an intermediate focusing point and then outputted to the external exposure unit.

The exposure unit includes optics for illuminating a mask and optics for projecting an image of the mask on a work piece, and exposes the mask pattern on the work piece to light by using the EUV light.

Although the mass flow controller is used for controlling the flow rate of the reducing gas, the pressurization gas, or the exhaust gas in the examples as shown in FIGS. 1, 2, 4, 5, 7 and 11, the present invention is not limited to these examples, but a unit suitable for supplying or evacuating a gas may be used in the apparatus according to the present invention.

Further, although a spherical solid is used as the target material in the examples as shown in FIGS. 1, 2, 4, 5, 7 and 11, the present invention is not limited to these examples, but the target material may be a metal ingot, or a liquid metal overheated and melted in advance. In these cases, reduction to a certain degree of oxides of the target material can be performed.

The invention claimed is:

1. A target supply unit to be used in an extreme ultraviolet light source apparatus for generating extreme ultraviolet light by irradiating a target material with a laser beam to turn the target material into plasma, said target supply unit comprising:

a target container configured to accommodate the target material;

a target nozzle configured to inject the target material supplied from said target container;

a reducing gas supply unit configured to supply a reducing gas into said target container;

an exhaust pipe configured to exhaust a gas within said target container;

a gas analysis unit configured to measure concentration of a reaction product of the reducing gas in said exhaust pipe to output a signal representing the concentration of the reaction product of the reducing gas; and a control unit configured to control said reducing as supply unit to stop supply of the reducing gas when the concentration of the reaction product of the reducing gas becomes not more than a predetermined value according to the signal outputted from said gas analysis unit.

2. The target supply unit according to claim 1, further comprising:

a heater attached to said target container and electrically connected to said control unit.

3. The target supply unit according to claim 1, wherein said reducing gas contains at least one of hydrogen gas, hydrogen radical, and carbon monoxide gas.

4. The target supply unit according to claim 3, further comprising:

a radicalizing unit configured to radicalize the hydrogen gas contained in said reducing gas.

5. The target supply unit according to claim 1, further comprising:

a gasifying unit configured to gasify a reducing agent, which is in a liquid state at room temperature, to generate said reducing gas.

6. The target supply unit according to claim 5, wherein said reducing agent, which is in a liquid state at room temperature, contains an acid solution.

7. The target supply unit according to claim 1, further comprising:

a pressurization gas supply unit configured to supply a pressurization gas for adjusting pressure within said target container and diluting said reducing gas.

8. The target supply unit according to claim 1, further comprising:

a pressure container configured to accommodate the target material supplied from said target container, wherein said target nozzle injects the target material supplied from said target container via said pressure container.

9. The target supply unit according to claim 1, wherein said reducing gas supply unit includes at least one mass flow controller electrically connected to said control unit.

10. The target supply unit according to claim 1, further comprising:

a heater provided to a pipe connected to said target container.

11. The target supply unit according to claim 1, further comprising:

a temperature sensor provided to said target container.

12. The target supply unit according to claim 1, further comprising:

a pressure sensor configured to measure pressure within said target container.

13. The target supply unit according to claim 1, wherein said gas analysis unit includes one of a dew-point meter and a Fourier transform infrared spectrophotometer.

14. The target supply unit according to claim 4, wherein said radicalizing unit includes one of a microwave plasma unit and a high-temperature heating unit using a filament.

15. The target supply unit according to claim 6, wherein said reducing agent contains one of formic acid, acetic acid, and hydrochloric acid.

* * * * *